US009457560B2

(12) United States Patent
Ready et al.

(10) Patent No.: US 9,457,560 B2
(45) Date of Patent: Oct. 4, 2016

(54) METHOD OF SENSING DEGRADATION OF PIEZOELECTRIC ACTUATORS

(71) Applicant: XEROX CORPORATION, Norwalk, CT (US)

(72) Inventors: Steven E. Ready, Los Altos, CA (US); Terrance L. Stephens, Canby, OR (US); David L. Knierim, Wilsonville, OR (US); David Alan Tence, Tualatin, OR (US)

(73) Assignees: XEROX CORPORATION, Norwalk, CT (US); PALO ALTO RESEARCH CENTER INCORPORATION, Palo Alto, CA (US)

( * ) Notice: Subject to any disclaimer, the term of this patent is extended or adjusted under 35 U.S.C. 154(b) by 0 days.

(21) Appl. No.: 14/495,596

(22) Filed: Sep. 24, 2014

(65) Prior Publication Data

US 2016/0082720 A1 Mar. 24, 2016

(51) Int. Cl.
*B41J 2/045* (2006.01)
*B41J 2/14* (2006.01)

(52) U.S. Cl.
CPC ..... *B41J 2/04506* (2013.01); *B41J 2/0451* (2013.01); *B41J 2/04581* (2013.01); *B41J 2002/14354* (2013.01)

(58) Field of Classification Search
CPC ..... B41J 2/04581; B41J 2/0451
See application file for complete search history.

(56) References Cited

U.S. PATENT DOCUMENTS

| | | | | |
|---|---|---|---|---|
| 4,695,852 | A | 9/1987 | Scardovi | |
| 5,500,657 | A | 3/1996 | Yauchi et al. | |
| 5,757,392 | A * | 5/1998 | Zhang | B41J 2/04581 347/14 |
| 6,375,299 | B1 * | 4/2002 | Foster | B41J 2/0451 347/19 |
| 6,682,162 | B2 | 1/2004 | Simons et al. | |
| 6,910,751 | B2 | 6/2005 | Groninger et al. | |
| 6,926,388 | B2 | 8/2005 | Groninger et al. | |
| 7,357,474 | B2 | 4/2008 | Groninger et al. | |
| 7,387,356 | B2 * | 6/2008 | Shinkawa | B41J 2/16579 347/19 |
| 7,703,893 | B2 | 4/2010 | Groninger et al. | |
| 7,753,497 | B2 * | 7/2010 | Yagi | B41J 2/14233 128/200.13 |
| 8,177,338 | B2 | 5/2012 | Andrews et al. | |
| 2002/0089562 | A1 * | 7/2002 | Simons | B41J 2/0451 347/19 |
| 2005/0219286 | A1 * | 10/2005 | Nagashima | B41J 2/0451 347/9 |
| 2006/0055745 | A1 * | 3/2006 | Yagi | B41J 2/14233 347/71 |
| 2015/0054879 | A1 * | 2/2015 | Ready | B41J 29/393 347/19 |

* cited by examiner

*Primary Examiner* — Stephen Meier
*Assistant Examiner* — John P Zimmermann
(74) *Attorney, Agent, or Firm* — MH2 Technology Law Group LLP

(57) ABSTRACT

Systems and methods for sensing degradation of a piezoelectric actuator in a print head. One or more electrical pulses may be transmitted to the piezoelectric actuator that cause the piezoelectric actuator to bend, thereby creating a pressure wave. The pressure wave may be sensed and converted into an electrical signal. The electrical signal may be compared to a reference signal.

8 Claims, 5 Drawing Sheets

METHOD OF SENSING DEGRADATION OF PIEZOELECTRIC ACTUATORS

TECHNICAL FIELD

The present teachings relate generally to ink jet printers and, more particularly, to sensing degradation of piezoelectric actuators in ink jet print heads.

BACKGROUND

An ink jet print head includes a piezoelectric actuator that provides energy to eject ink from the print head through a nozzle onto a medium (e.g. paper). Over time and use, the piezoelectric actuator may begin to fail. For example, the piezoelectric actuator may structurally degrade, the material making up the piezoelectric actuator may "de-pole," or the adhesive material bonding the piezoelectric actuator to the membrane of the ejection chamber may degrade.

To sense whether the piezoelectric actuator is operating properly, the print head ejects ink onto the medium, and then the image on the medium is analyzed for irregularities in the ink. This information may be fed back to the print engine for print process adjustment or print head maintenance. What is needed, therefore, is an improved system and method for sensing degradation of piezoelectric actuators.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A method for sensing degradation of a piezoelectric actuator in a print head is disclosed. The method may include transmitting one or more electrical pulses to the piezoelectric actuator that cause the piezoelectric actuator to bend, thereby creating a pressure wave. The pressure wave may be sensed and converted into an electrical signal. The electrical signal may be compared to a reference signal.

In another embodiment, the method may include transmitting one or more first electrical pulses to the piezoelectric actuator at a first time. The one or more first electrical pulses may cause the piezoelectric actuator to bend, thereby creating a first pressure wave. The first pressure wave may be converted to a first electrical signal with the piezoelectric actuator. One or more second electrical pulses may be transmitted to the piezoelectric actuator at a second time that is after the first time. The one or more second electrical pulses may cause the piezoelectric actuator to bend, thereby creating a second pressure wave. The second pressure wave may be converted to a second electrical signal with the piezoelectric actuator. The first and second electrical signals may be compared.

A circuit in a printer is also disclosed. The circuit may include a voltage source and a field effect transistor connected to the voltage source. At least one first resistor may be connected to the voltage source and the field effect transistor. An amplifier may be connected to the at least one first resistor. At least one first diode may be connected to the at least one first resistor.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, 3D printer that can make a 3D objects, etc. It will be understood that the structures depicted in the figures may include additional features not depicted for simplicity, while depicted structures may be removed or modified.

Figure 1:
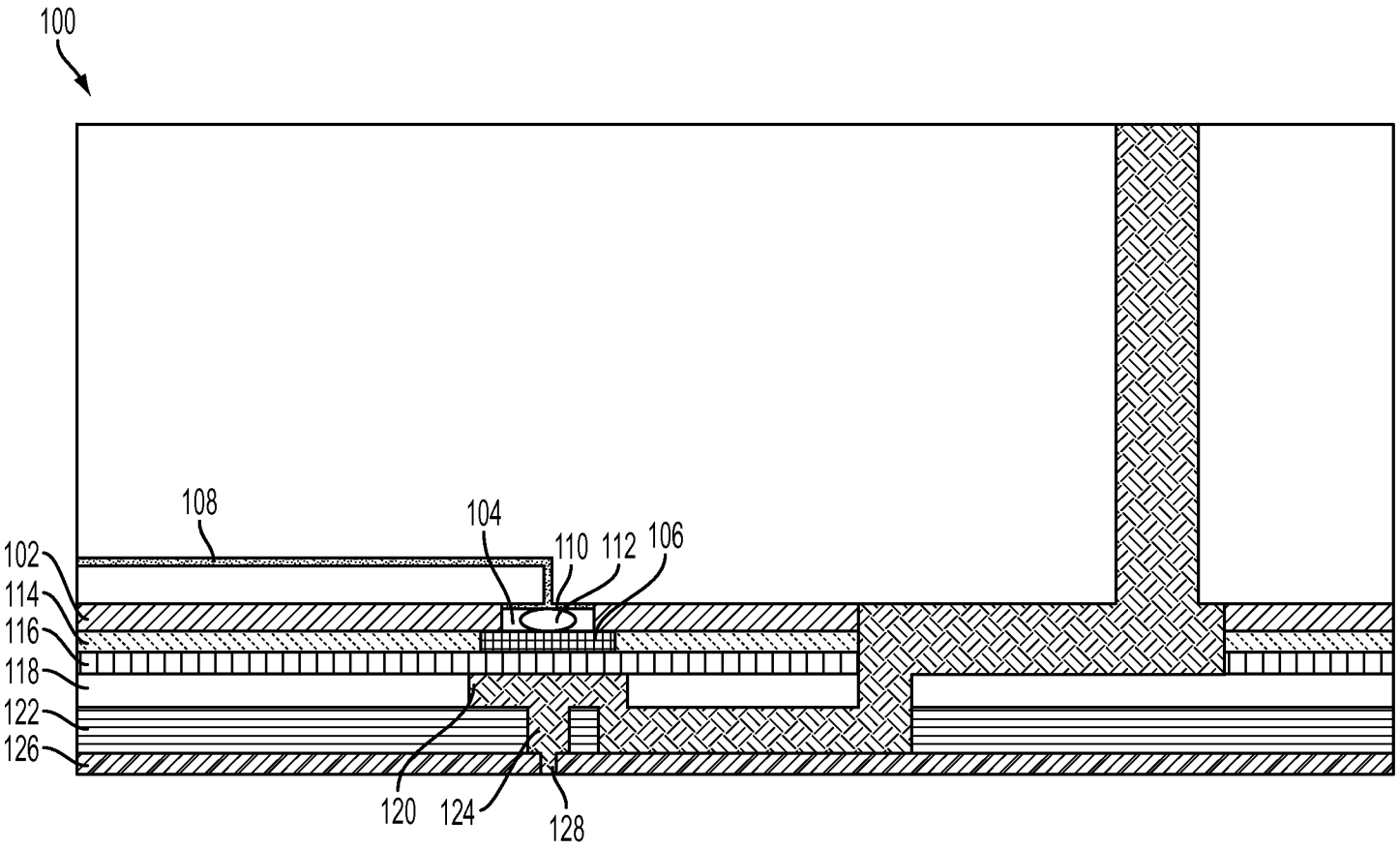
FIG. 1 depicts a cross-sectional view of a portion of an illustrative jet in a print head assembly, according to one or more embodiments disclosed.

FIG. 1 depicts a cross-sectional view of a portion of an illustrative jet 100 in a print head assembly, according to one or more embodiments disclosed. The jet 100 may include a standoff layer 102 that leaves an air gap 104 above a piezoelectric actuator 106. The piezoelectric actuator 106 may bend or flex when an electric current is transmitted through an actuator driver 108 to a metallic film 110 coupled to the piezoelectric actuator 106. A flexible electrically-conductive connector 112 may couple the metallic film 110 with the piezoelectric actuator 106, allowing electric current to flow to the piezoelectric actuator 106. The connector 112 may be an electrically-conductive adhesive such as silver epoxy, which maintains the electrical connection with the piezoelectric actuator 106 when the piezoelectric actuator 106 bends either toward or away from the metallic film 110.

The piezoelectric actuator 106 may be surrounded by a spacer layer 114. The standoff layer 102 and the spacer layer 114 may each have a thickness from about 25 μm to about 50 μm, and the piezoelectric actuator 106 may have a thickness from about 25 μm to about 75 μm. The piezoelectric actuator 106 and the spacer layer 114 may be coupled to a flexible diaphragm 116 located below the piezoelectric actuator 106 and the spacer layer 114. The electric current driving the piezoelectric actuator 106 may bend the piezoelectric actuator 106 toward the diaphragm 116 and/or away from the diaphragm 116. The diaphragm 116 may respond to the bending of the piezoelectric actuator 106, and return to its original shape once the electric current to the piezoelectric actuator 106 ceases. The diaphragm 116 may have a thickness from about 10 μm to about 40 μm.

A body layer 118 may be positioned below the diaphragm 116. The walls of the body layer 118 may at least partially define a pressure chamber 120. The body layer 118 and the pressure chamber 120 may have a thickness from about 38 μm to about 50 μm. A nozzle brace layer 122 may be positioned below the body layer 118 and form lateral walls around an outlet 124, which may be in fluid communication with the pressure chamber 120. The nozzle brace layer 122 and the outlet 124 may have a thickness from about 40 μm to about 60 μm. The combined volumes of the pressure chamber 120 and the outlet 124 may be less than or equal to about 0.025 $mm^3$.

A nozzle plate 126 may be positioned below the nozzle brace layer 122. The nozzle plate 126 may define an ink nozzle 128 that is in fluid communication with (and narrower than) the outlet 124. The ink nozzle 128 may be in fluid communication with the outlet 124. The nozzle plate 126 may have a thickness from about 20 μm to about 30 μm. Although one jet 100 is shown, it will be appreciated that the number of jets in the print head assembly may be from about 10 to about 100, from 100 to about 1,000, from 1,000 to about 10,000, or more.

Figure 2:
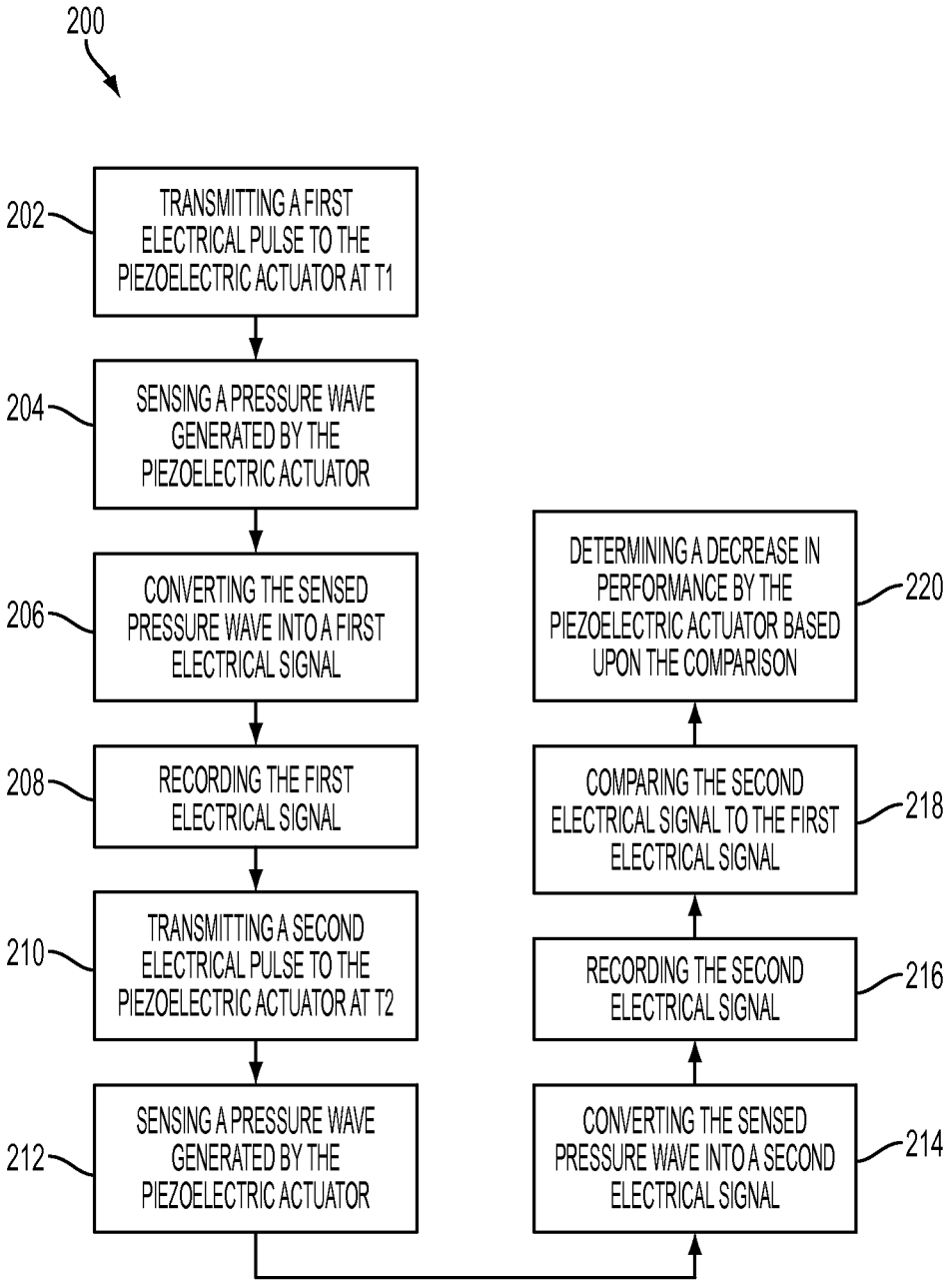
FIG. 2 depicts a flowchart of an illustrative method for sensing degradation of a piezoelectric actuator in the jet, according to one or more embodiments disclosed.

FIG. 2 depicts a flowchart 200 of an illustrative method for sensing degradation of the piezoelectric actuator 106 in the jet 100, according to one or more embodiments disclosed. Referring to FIGS. 1 and 2, one or more first electrical pulses may be transmitted to the piezoelectric actuator 106 at a first time ($T_1$), as at 202. For example, the one or more first electrical pulses may be transmitted through the actuator driver 108, the metallic film 110, and the connector 112 to the piezoelectric actuator 106, as shown in FIG. 1. $T_1$ may be proximate to the beginning of the life of the jet 100 (e.g., during manufacturing or soon after installation). In other words, $T_1$ may occur at a time when the piezoelectric actuator 106 is known to be new, healthy, and/or operating as intended In at least one embodiment, the one or more first electrical pulses may include at least one positive pulse and at least one negative pulse. The one or more first electrical pulses may cause the piezoelectric actuator 106 to bend toward and/or away from the ink nozzle 128, thereby generating a pressure wave (e.g., in the chamber 120). The one or more first electrical pulses may be below a threshold voltage and/or threshold current such that the pressure wave generated by the piezoelectric actuator 106 does not cause ink to be ejected through the ink nozzle 128.

The pressure wave generated by the piezoelectric actuator 106 may be sensed, as at 204. In at least one embodiment, the piezoelectric actuator 106 that generated the pressure wave may also be used to sense the size (e.g., amplitude) of the pressure wave. In another embodiment, a separate sensor may be positioned in or proximate to the chamber 120 to sense the size of the pressure wave.

The sensed pressure wave may be converted into a first electrical signal, as at 206. For example, the pressure wave may be converted to the first electrical signal by the piezoelectric actuator 106. The first electrical signal may then be recorded, as at 208.

One or more second electrical pulses may be transmitted to the piezoelectric actuator 106 at a second time ($T_2$), as at 210. $T_2$ may occur after $T_1$. For example, $T_2$ may occur after $T_1$ by one month, six months, one year, or more. In at least one embodiment, $T_2$ may be selected based upon a predetermined amount of usage of the jet 100 (e.g., actuations of the piezoelectric actuator 106).

In at least one embodiment, the one or more second electrical pulses may include at least one positive pulse and at least one negative pulse. The one or more second electrical pulses may cause the piezoelectric actuator 106 to bend toward and/or away from the ink nozzle 128, thereby generating a pressure wave (e.g., in the chamber 120). The one or more second electrical pulses may be below a threshold voltage and/or threshold current such that the pressure wave generated by the piezoelectric actuator 106 does not cause ink to be ejected through the ink nozzle 128. The one or more second electrical pulses may be the same voltage and/or current as the one or more first electrical pulses. As used herein, the "same" voltage and/or current allows for a variation of +/−10%. In at least one embodiment, the one or more first electrical pulses and/or the one or more second electrical pulses may be configured to elicit enhanced spectral responses of known resonances that are sensitive to failure modes for the piezoelectric actuator 106.

The pressure wave generated by the piezoelectric actuator 106 may be sensed, as at 212. The sensed pressure wave may be converted into a second electrical signal, as at 214. For example, the pressure wave may be converted to the second electrical signal by the piezoelectric actuator 106. The second electrical signal may be recorded, as at 216. The second electrical signal may then be compared to the first electrical signal, as at 218. The comparison may involve a time domain comparison to a known signal (e.g., the first electrical signal), a fast Fourier transform ("FFT") at central peak frequency, a magnitude of oscillation damping, a fast Fourier transform at peak width, a combination thereof, or the like. The decrease in performance of the piezoelectric actuator 106 from $T_1$ to $T_2$ may be determined based upon the comparison of the first and second electrical signals, as at 220.

The method may be conducted for each jet 100 in the print head assembly so that the decrease in efficiency (e.g., drift) of each individual jet 100 may be determined. In another embodiment, values for all or a subset of the jets 100 may be determined and recorded (e.g., at 208) at $T_1$ and averaged. The values for the same jets 100 may then be determined and recorded (e.g., at 216) at $T_2$ and averaged, and the average values at $T_1$ and $T_2$ may be compared (e.g., at 218). This measurement may be less sensitive to noise or anomalies of individual jets because it assumes the jets are substantially uniform.

Figure 3:
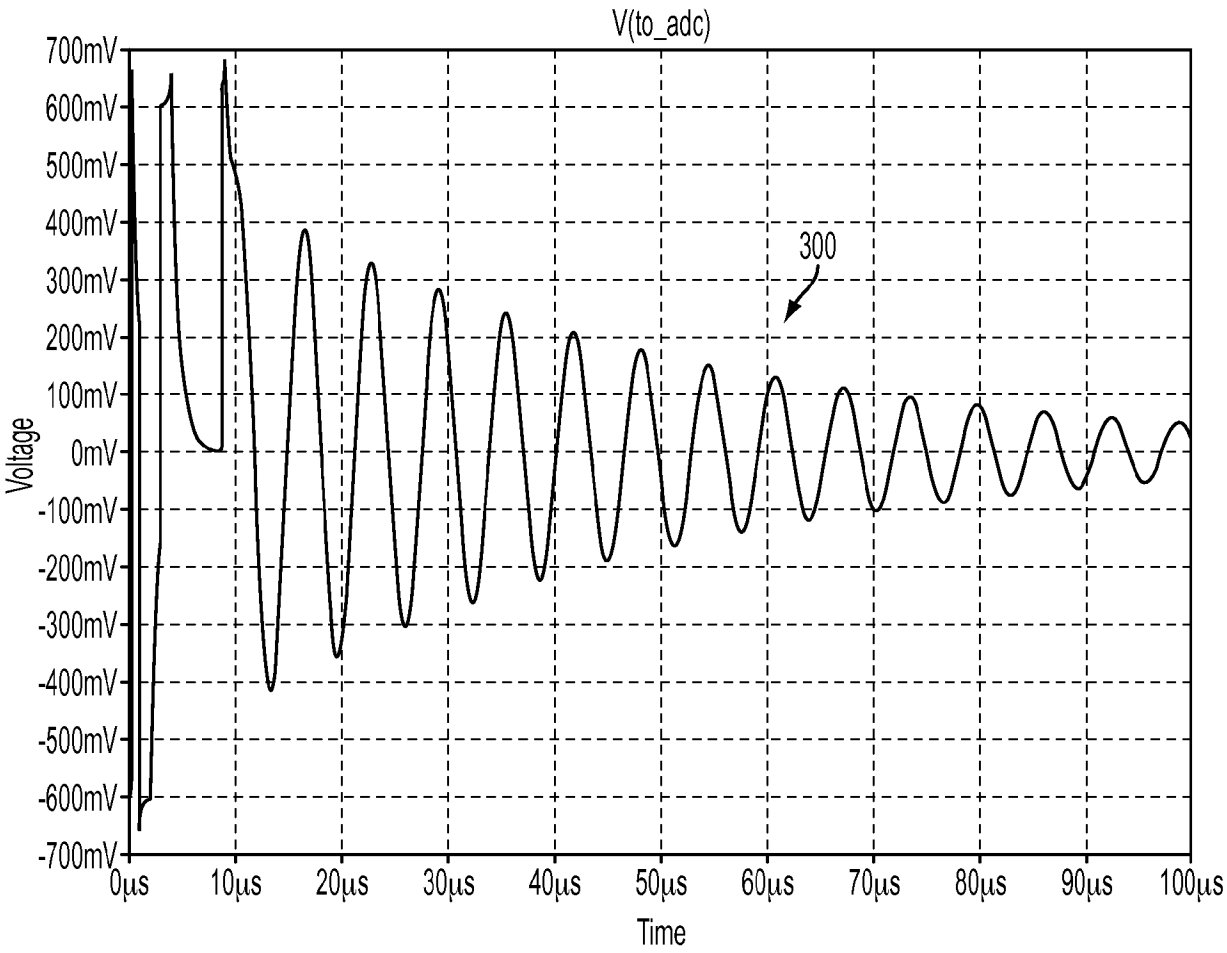
FIG. 3 depicts a first illustrative signal when the piezoelectric actuator is healthy, according to one or more embodiments disclosed.
Figure 4:
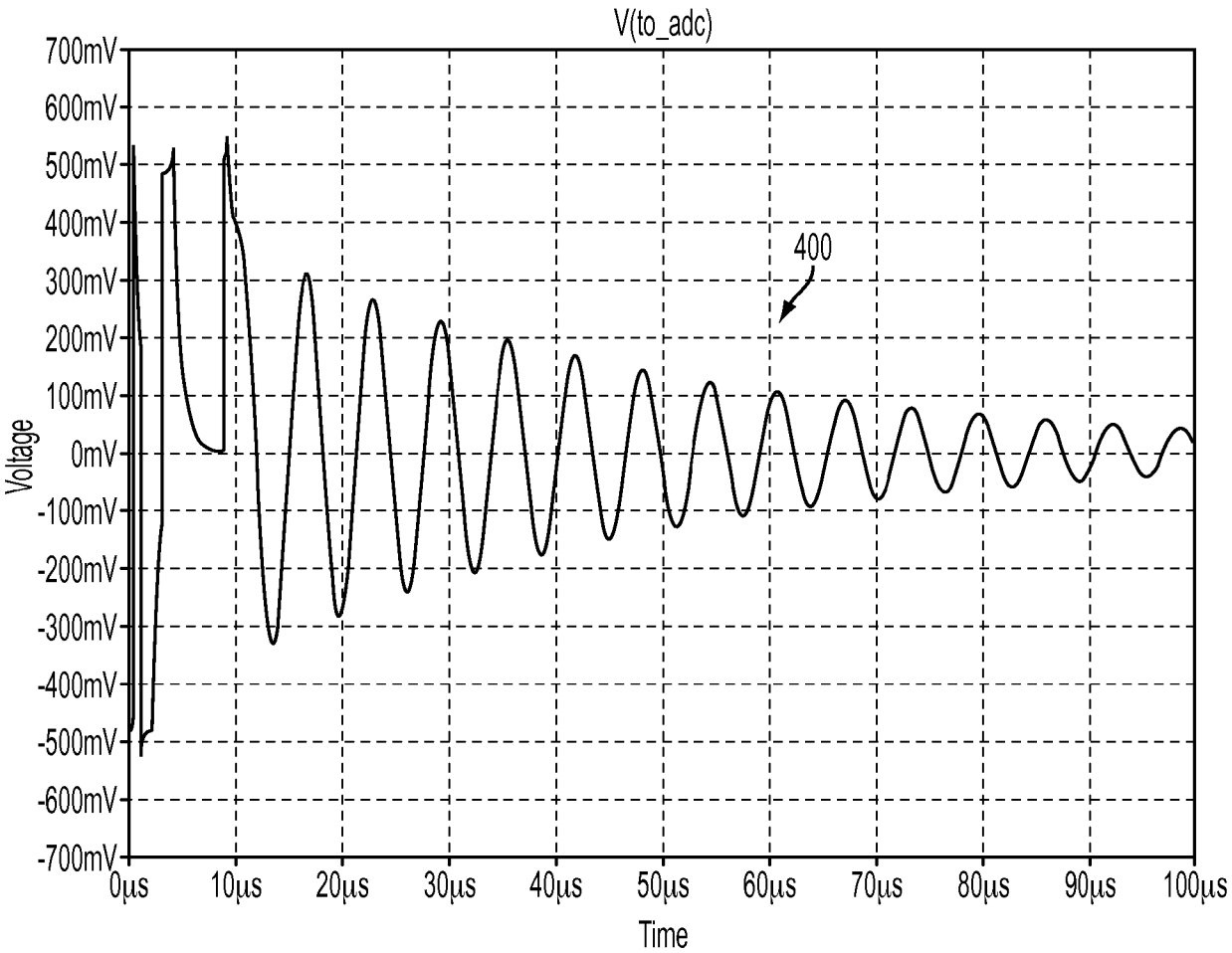
FIG. 4 depicts a second illustrative signal when the piezoelectric actuator is degraded, according to one or more embodiments disclosed.

FIG. 3 depicts an illustrative first electrical signal 300, and FIG. 4 depicts an illustrative second electrical signal 400, according to one or more embodiments disclosed. As shown, the first and second electrical signals 300, 400 may resemble sine waves with amplitudes that decrease over time as the pressure waves attenuate. The amplitudes may decrease to equilibrium in less than or equal to about 150 μs. As used herein, "equilibrium" refers an amplitude that is less than or equal to about 1% of the maximum amplitude of the signal 300, 400.

The first electrical signal 300 corresponds to $T_1$ when the piezoelectric actuator 106 is known to be new, healthy, and/or operating as intended. Thus, at $T_1$, the piezoelectric actuator 106 may be considered to be operating at 100% efficiency. Accordingly, the first electrical signal 300 may also be referred to as a reference signal. The second electrical signal 400 corresponds to $T_2$ at which the piezoelectric actuator 106 may not be operating as efficiently as at $T_1$ (e.g., due to partial degradation over time and/or use).

For example, as may be seen by comparing the first and second electrical signals 300, 400, the amplitude of the second electrical signal 400 is about 81% of the amplitude of the first electrical signal 300. From this, an operator may determine the decrease in efficiency of the piezoelectric actuator 106 from $T_1$ to $T_2$. The efficiency of the piezoelectric actuator 106 at $T_2$ may be determined from the following equation:

$$\left(\frac{E_2}{E_1}\right)^2 = \frac{A_2}{A_1} \tag{1}$$

Where $E_1$ represents the efficiency of the piezoelectric actuator 106 at $T_1$ (known to be 100%), $E_2$ represents the efficiency of the piezoelectric actuator 106 at $T_2$, $A_1$ represents the amplitude of the first electrical signal 300 at $T_1$, and $A_2$ represents the amplitude of the second electrical signal 400 at $T_2$. Using the information above, an operator may solve for $E_2$:

$$\left(\frac{E_2}{1.00}\right)^2 = 0.81 \tag{2}$$

Thus, in this example, $E_2$=0.90. In other words, the efficiency of the piezoelectric actuator 106 has decreased from 100% (at $T_1$) to 90% (at $T_2$).

Looking at this another way, if the efficiency of the piezoelectric actuator 106 at $T_2$ is 90%, then the pressure wave generated by the piezoelectric actuator 106 may only be 90% as large as the pressure wave generated by the piezoelectric actuator 106 at $T_1$. In addition, the piezoelectric actuator 106 may only be able to sense 90% of the pressure wave. Thus, the efficiency of the piezoelectric actuator 106 factors in twice, and is thus squared.

Figure 5:
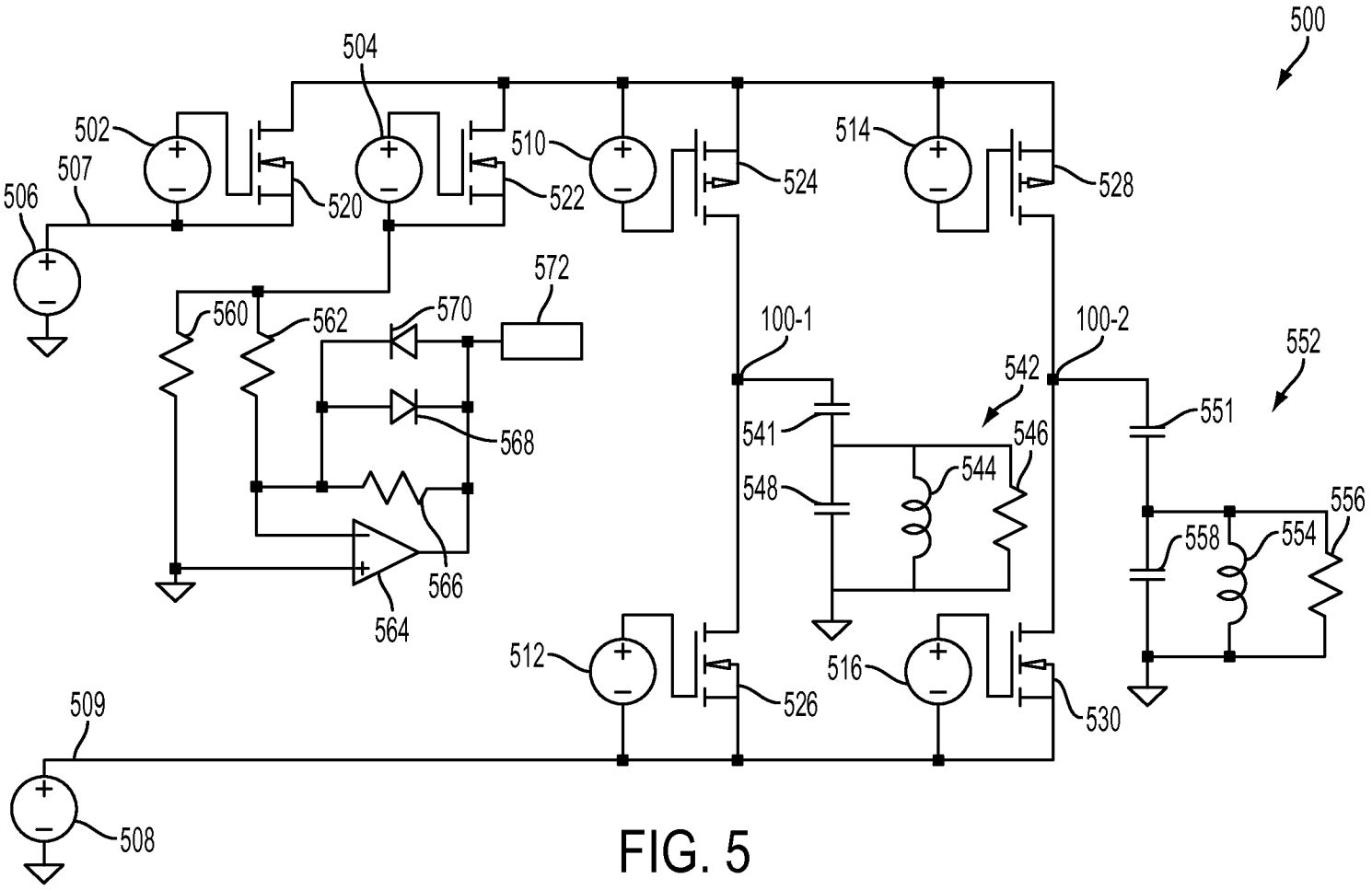
FIG. 5 depicts a schematic diagram of an illustrative circuit for sensing degradation of the piezoelectric actuator in the print head assembly, according to one or more embodiments disclosed.

FIG. 5 depicts a schematic diagram of an illustrative circuit 500 for sensing degradation of the piezoelectric actuator 106 in the jet 100, according to one or more embodiments disclosed. The circuit 500 may include a plurality of voltage sources (six are shown: 502, 504, 506, 508, 510, 512). The voltage 507 from the voltage source 506 may provide the one or more positive electrical pulses to the piezoelectric actuator 106 (in FIG. 1), and the voltage 509 from the voltage source 508 may provide the one or more negative electrical pulses to the piezoelectric actuator 106.

Field effect transistors ("FETs") 524, 526, 528, 530 represent circuitry associated with jets 100-1, 100-2. Although only two jets 100-1, 100-2 are shown for simplicity, it will be appreciated that hundreds or thousands of jets may be present. Each jet 100 may be modelled by an equivalent electrical LRC circuit 542, 552. Each LRC circuit 542, 552 may include an inductor 544, 554 (e.g., 100 μH), a resistor 546, 556 (e.g., 2k•), and a capacitor 548, 558 (e.g., 10 nF). In addition, a capacitor 541, 551 (e.g., 100 pF) may be in series with each LRC circuit 542, 552, respectively.

To drive the jet 552, the FET 528 may be turned on via voltage from the voltage source 514 during the positive voltage pulse 507 from the voltage source 506, and again after the end of the negative voltage pulse 509 from the voltage source 508. The FET 530 may be turned on via the voltage source 516 during the negative pulse 509 from the voltage source 508.

The FET 520 may normally be on, but may be turned off after a voltage pulse pair 507, 509 from the voltage sources 506, 508, respectively. The FET 522 may normally be off, but may be turned on after a voltage pulse pair 507, 509 from the voltage sources 506, 508, respectively. The FET 522 may be connected to one or more resistors 560, 562. The resistors 560, 562 may be, for example, about 1000 apiece. One of the resistors 560 may be connected to the positive terminal of an amplifier 564, and the other resistor 562 may be connected to the negative terminal of the amplifier 564.

The second resistor 562 may also be connected to a third resistor 566 (e.g., 100 k•), the input of a first diode 568, and the output of a second diode 570. The first and second diodes 568, 570 may be in parallel and allow current to flow in opposite directions. The output of the amplifier 564 may be connected to the third resistor 566, the output of the first diode 568, and the input of the second diode 570. The output of the amplifier 546 may produce the first electrical signal 300 (FIG. 3) and the second electrical signal 400 (FIG. 4) at times $T_1$ and $T_2$, respectively. The output of the amplifier 546 may also be connected to an analog to digital ("ADC") converter 572 for further processing of the signals 300, 400.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural objects and/or processing stages may be added, or existing structural objects and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be some-what altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A method for sensing degradation of piezoelectric actuators in a printer, comprising:

transmitting one or more first electrical pulses to a first piezoelectric actuator during a first time period, wherein the one or more first electrical pulses cause the first piezoelectric actuator to bend, thereby creating a first pressure wave;

transmitting one or more second electrical pulses to a second piezoelectric actuator during the first time period, wherein the one or more second electrical pulses cause the second piezoelectric actuator to bend, thereby creating a second pressure wave;

sensing an amplitude of the first pressure wave using the first piezoelectric actuator that created the first pressure wave;

sensing an amplitude of the second pressure wave using the second piezoelectric actuator that created the second pressure wave;

converting the first pressure wave to a first electrical signal with the first piezoelectric actuator;

converting the second pressure wave to a second electrical signal with the second piezoelectric actuator;

averaging the first and second electrical signals to produce a first averaged electrical signal;

transmitting one or more third electrical pulses to the first piezoelectric actuator during a second time period that is after the first time period based upon a predetermined amount of usage of the first piezoelectric actuator, wherein the one or more third electrical pulses cause the first piezoelectric actuator to bend, thereby creating a third pressure wave;

transmitting one or more fourth electrical pulses to the second piezoelectric actuator during the second time period, wherein the one or more fourth electrical pulses cause the second piezoelectric actuator to bend, thereby creating a fourth pressure wave;

sensing an amplitude of the third pressure wave using the first piezoelectric actuator that created the third pressure wave;

sensing an amplitude of the fourth pressure wave using the second piezoelectric actuator that created the fourth pressure wave;

converting the third pressure wave to a third electrical signal with the first piezoelectric actuator;

converting the fourth pressure wave to a fourth electrical signal with the second piezoelectric actuator;

averaging the third and fourth electrical signals to produce a second averaged electrical signal; and comparing the first and second averaged electrical signals to identify a spectral response of a known resonance that indicates that the first piezoelectric actuator, the second piezoelectric actuator, or both is degraded or failing.

2. The method of claim 1, wherein the one or more third electrical pulses have substantially the same voltage, current, or both as the one or more first electrical pulses.

3. The method of claim 1, wherein the one or more first electrical pulses are below a threshold level such that the first pressure wave does not cause ink to be ejected out of a nozzle in the print head.

4. The method of claim 1, wherein the one or more second electrical pulses comprise one or more positive electrical pulses, one or more negative electrical pulses, or a combination thereof.

5. The method of claim 1, wherein an efficiency of operation of the printer at the second time period is equal to a square root of $$\frac{A_2}{A_1},$$

where $A_1$ represents an amplitude of the first averaged electrical signal, and $A_2$ represents an amplitude of the second averaged electrical signal.

6. The method of claim 1, wherein the first and third electrical signals resemble sine waves with amplitudes that decrease over time.

7. The method of claim 1, wherein comparing the first and second averaged electrical signals comprises a time domain comparison to the reference signal, a fast Fourier transform, a comparison of center frequencies, a comparison of magnitude of oscillation damping, or a combination thereof.

8. The method of claim 1, wherein:

a standoff layer is positioned above the first piezoelectric actuator, and the standoff layer leaves an air gap above the first piezoelectric actuator;

a flexible electrically-conductive connector couples a metallic film to the first piezoelectric actuator, wherein the electically-conductive connector comprises a silver epoxy;

a spacer layer at least partially surrounding the first piezoelectric actuator;

a flexible diaphragm coupled to and positioned below the first piezoelectric actuator and the spacer layer;

a body layer positioned below the flexible diaphragm, wherein walls of the body layer define a pressure chamber;

a nozzle brace layer positioned below the body layer that defines an outlet that is in fluid communication with the pressure chamber; and a nozzle plate positioned below the nozzle brace layer that defines an in nozzle that is in fluid communication with the outlet, wherein the ink nozzle is more narrow than the outlet.

* * * * *